US012092415B2

(12) United States Patent
Rhode et al.

(10) Patent No.: US 12,092,415 B2
(45) Date of Patent: Sep. 17, 2024

(54) BORE GUIDE

(71) Applicant: New Revo Brand Group, LLC, Plymouth, MN (US)

(72) Inventors: Mike Rhode, Coon Rapids, MN (US); James Hofman, Eden Prairie, MN (US); Daniel Zaleskas, St. Louis Park, MN (US); Ryan Jacobson, Andover, MN (US)

(73) Assignee: New Revo Brand Group, LLC, Plymouth, MN (US)

( * ) Notice: Subject to any disclaimer, the term of this patent is extended or adjusted under 35 U.S.C. 154(b) by 0 days.

(21) Appl. No.: 18/162,115

(22) Filed: Jan. 31, 2023

(65) Prior Publication Data

US 2024/0255249 A1 Aug. 1, 2024

(51) Int. Cl.
*F41A 29/02* (2006.01)

(52) U.S. Cl.
CPC ..... *F41A 29/02* (2013.01)

(58) Field of Classification Search
CPC ..... F41A 29/02
USPC ..... 42/95
See application file for complete search history.

(56) References Cited

U.S. PATENT DOCUMENTS

| | | | | |
|---|---|---|---|---|
| 619,906 | A * | 2/1899 | Phillips | F42B 33/10 15/104.095 |
| 2,409,916 | A | 10/1946 | Varcoe | |
| 2,447,869 | A | 8/1948 | Pearson et al. | |
| 2,877,484 | A | 3/1959 | Taylor et al. | |
| 3,480,982 | A | 12/1969 | Saunders | |
| 4,803,792 | A | 2/1989 | Brown, Jr. et al. | |
| 4,896,447 | A | 1/1990 | Badoni | |
| 4,962,607 | A | 10/1990 | Baldwin | |
| 5,204,483 | A | 4/1993 | Tellechea | |
| 5,815,975 | A | 10/1998 | Rambo et al. | |
| 5,983,550 | A | 11/1999 | Skaar | |
| 6,269,579 | B1 | 8/2001 | Warner | |
| 11,320,227 | B2 * | 5/2022 | Williams | F41A 29/02 |
| 2013/0047484 | A1 * | 2/2013 | Wickser, Jr. | F41A 17/44 42/95 |
| 2016/0202015 | A1 * | 7/2016 | Poehlman | F41A 29/02 42/90 |

(Continued)

OTHER PUBLICATIONS

Bore Tech, Bore Guide—Bolt Action Centerfire, https://www.boretech.com/products/bore-guide-bolt-action-centerfire, accessed Jul. 22, 2021.

(Continued)

*Primary Examiner* — Bret Hayes
(74) *Attorney, Agent, or Firm* — GRUMBLES LAW PLLC; Brittany Haanan

(57) ABSTRACT

A bore guide comprised of a rear housing, an adjustable shaft having a proximal and a distal end, a tip on the distal end of the adjustable shaft, a spring housing connected to the proximal end of the adjustable shaft, a spring located inside the spring housing, and a lock insertable into a portion of a firearm to lock the spring in a compressed state. The rear housing may have a rear opening on a proximal end of the rear housing and a solvent port on a circumferential portion of the rear housing. Transition of the adjustable shaft toward the rear opening can cause compression of the spring. The lock can secure the bore guide in place and create a seal within the bore of the firearm.

20 Claims, 10 Drawing Sheets

(56) References Cited

U.S. PATENT DOCUMENTS

2022/0373287 A1* 11/2022 Larson ..... F41A 29/02

OTHER PUBLICATIONS

Bore Tech, Patch Guide—AR-15/AR-10, https://www.boretech.com/products/patch-guide-ar-15-ar-10, accessed Jul. 22, 2021.
Midway, Shooter's Choice Universal Bore Guide, https://www.midwayusa.com/product/1022464869, accessed Jan. 30, 2023.
Tipton, Rapid Bore Guide Kit, https://www.tiptonclean.com/cleaning-tools/bore-guides/rapid-bore-guide-kit/777999. html, accessed Jul. 22, 2021.
Tipton, Universal Bore Guide, https://www.tiptonclean.com/cleaning-tools/bore-guides/universal-bore-guide/777888. html, accessed Jul. 22, 2021.
Wheeler, Delta Series Bore Guide, https://www.wheelertools.com/delta-series-bore-guide/156213.html, accessed Jul. 22, 2021.

* cited by examiner

BORE GUIDE

FIELD OF THE INVENTION

This disclosure relates to a bore cleaning tool. More specifically, it relates to a bore guide for insertion into a barrel of a firearm to assist with aligning and guiding a cleaning rod within the bore of the firearm.

BACKGROUND OF THE INVENTION

After use and throughout their lives, firearm bores are affected by debris, moisture, rust, copper, carbon, and gunpowder residue. Therefore, gun bores need to be cleaned so they can function properly and so they do not rust and decay. Bore guides are known tools that are used to assist in cleaning bores by aligning bore brushes with the firearm bore and guiding the cleaning rod back and forth during use. This guiding action prevents unwanted bending or bowing of the cleaning rod as well as rubbing of the cleaning rod upon the firearm. Additionally, bore guides prevent corrosive chemicals from contacting the firearm in areas outside of the barrel. However, currently existing bore guides have shortcomings such as time-consuming threaded fasteners that hold the bore guide in place when it is inserted into the bore. Therefore, a faster and easier retention mechanism is needed that can minimize effort and maximize efficiency for the user.

SUMMARY OF THE INVENTION

The present disclosure relates to a bore guide for insertion into the barrel of a firearm. In an illustrative but non-limiting example, the disclosure provides a bore guide that can include a rear housing, an adjustable shaft having a proximal end and a distal end, a tip on the distal end of the adjustable shaft, a spring housing between a distal end of the rear housing and the proximal end of the adjustable shaft, a spring located inside the spring housing, and a lock insertable into a portion of a firearm to lock the spring in a compressed state. The rear housing can have a rear opening on a proximal end of the rear housing and a solvent port on a circumferential portion of the rear housing. Transition of the adjustable shaft toward the rear opening can cause compression of the spring. The lock can secure the bore guide in place and create a seal within the bore of the firearm. The lock can be a key insertable into an ejection port of a firearm. The rear housing can be further comprised of at least two wings flanking the solvent port on the circumferential portion of the rear housing.

In some cases, the bore guide can further comprise a cover for the adjustable shaft, wherein the cover is connected to a distal end of the spring housing, and the adjustable shaft is slidable within the cover. The cover can be comprised of at least one key slot. The bore guide can be inserted into the firearm and compressed, and the at least one key slot can be accessible through an ejection port of the firearm. The lock can be comprised of a key that is insertable into the ejection port and pairable with the at least one key slot.

In some cases, the rear housing can be rotatable relative to the adjustable shaft and the spring housing. And in some cases, the rear housing can be further comprised of a guide tube located within at least the spring housing. The guide tube can be further located inside at least a portion of the adjustable shaft.

In some cases, the lock is a handle, and the bore guide is insertable into a receiver of the firearm. The handle can be located on a distal end of the spring housing.

In some cases, the proximal end of the adjustable shaft can be located within the spring housing, and the spring can be positioned between a proximal end of the spring housing and the proximal end of the adjustable shaft.

In another illustrative but non-limiting example, the disclosure provides a bore guide that can include a rear housing, an adjustable shaft having a proximal and a distal end, a tip on the distal end of the adjustable shaft, a spring housing connected to the proximal end of the adjustable shaft, a spring located inside the spring housing, a cover for the adjustable shaft, and a key that is pairable with the at least one key slot to lock the spring in a compressed state. The rear housing can have a rear opening on a proximal end of the rear housing, a solvent port on a circumferential portion of the rear housing, and at least two wings flanking the solvent port on the circumferential portion of the rear housing. Transition of the adjustable shaft toward the rear opening can cause compression of the spring. The lock can secure the bore guide in place and create a seal within the bore of the firearm. The cover can be connected to a distal end of the spring housing, slidable along an outer portion of the adjustable shaft, and comprised of at least one key slot.

In another illustrative but non-limiting example, the disclosure provides a bore guide that can include a rear housing, an adjustable shaft having a proximal and a distal end, a tip on the distal end of the adjustable shaft, a spring housing connected to the proximal end of the adjustable shaft, a spring located inside the spring housing, and a handle. The rear housing can have a rear opening on a proximal end of the rear housing, a solvent port on a circumferential portion of the rear housing, and a guide tube located within the spring housing and a portion of the adjustable shaft. Transition of the adjustable shaft toward the rear opening can cause compression of the spring. The bore guide can be insertable into a receiver of a firearm and the handle, when rotated downward into a locked position, can lock the spring in a compressed state. The handle can be located on a distal end of the spring housing. The lock can secure the bore guide in place and create a seal within the bore of the firearm.

In another illustrative, but non-limiting example, the disclosure provides a method for using a bore guide that can include inserting a distal end of the bore guide into a portion of a barrel of a firearm, compressing a spring of the bore guide until a lock can be engaged with a portion of the firearm, and engaging the lock to secure the compressed bore guide in place. The lock can secure the bore guide in place and create a seal within the bore of the firearm.

In some case, the bore guide can be comprised of a rear housing, an adjustable shaft having a proximal and a distal end, a tip on the distal end of the adjustable shaft, a spring housing connected to the proximal end of the adjustable shaft, a spring located inside the spring housing, and the lock. The rear housing can have a rear opening on a proximal end of the rear housing, and a solvent port on a circumferential portion of the rear housing. The tip can be the distal end of the bore guide that is insertable into a portion of the barrel of the firearm. Transition of the adjustable shaft toward the rear opening can cause compression of the spring. The lock can be engageable with a portion of the firearm to lock the spring in a compressed state.

In some cases, the method can further include pouring solvent into the solvent port, wherein the solvent port can be flanked by at least two wings on the circumferential portion of the rear housing. In some cases, the method can further include inserting a cleaning rod through the rear opening of the rear housing. In some cases, the method can further include disengaging the lock to allow the spring to decompress and removing the bore guide from the firearm.

DETAILED DESCRIPTION

Figure 1:
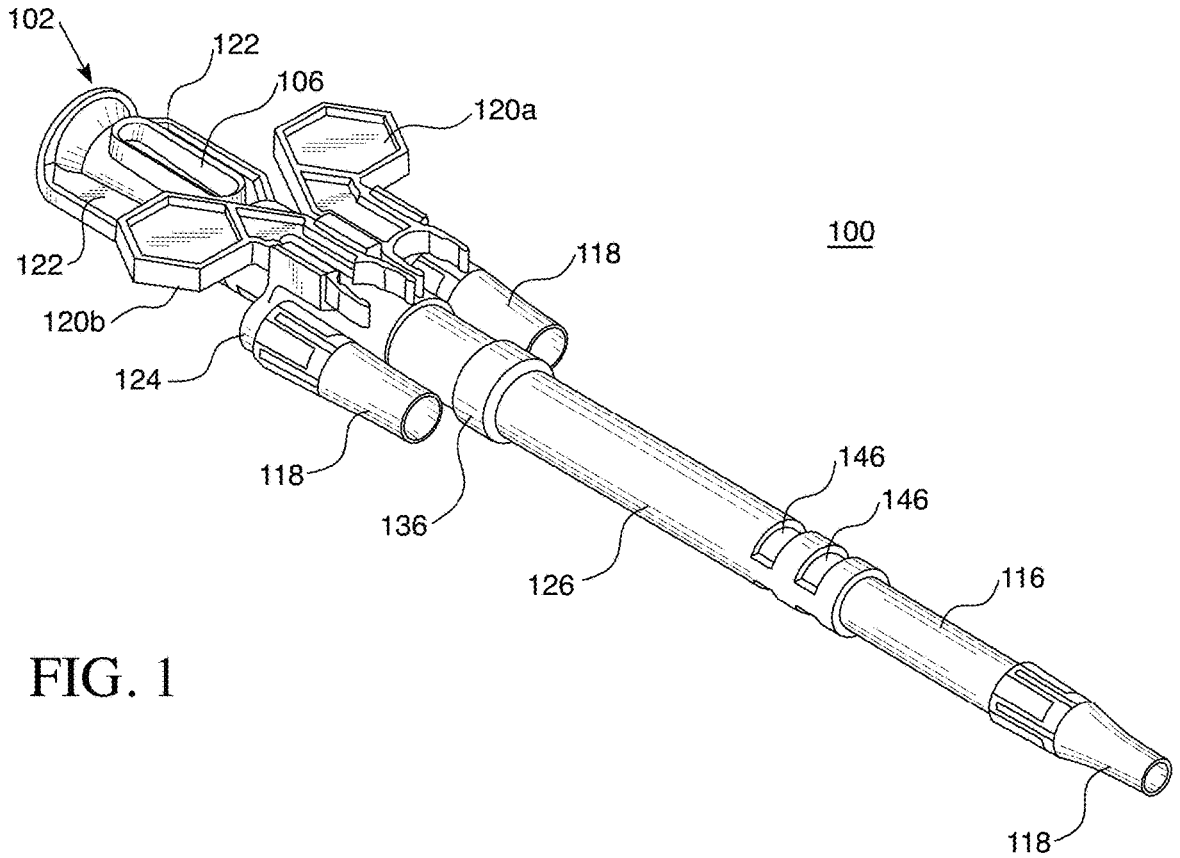
FIG. 1 is a top perspective view of a bore guide with attached accessories according to a first embodiment of the present disclosure.

The present disclosure relates to a bore guide that can be used to assist in cleaning the interior of the barrel (i.e., the bore) by aligning a bore brush with the firearm bore and guiding the cleaning rod back and forth during use. Various embodiments of the bore guide will be described in detail with reference to the drawings, wherein like reference numerals represent like parts and assemblies throughout the several views. Reference to various embodiments does not limit the scope of the bore cleaning tool disclosed herein. Additionally, any examples set forth in this specification are not intended to be limiting and merely set forth some of the many possible embodiments for the bore cleaning tool. It is understood that various omissions and substitutions of equivalents are contemplated as circumstances may suggest or render expedient, but these are intended to cover applications or embodiments without departing from the spirit or scope of the disclosure. Also, it is to be understood that the phraseology and terminology used herein are for the purpose of description and should not be regarded as limiting.

Some embodiments of the bore guide disclosed herein include features that ensure quick and efficient securing of the bore guide to a firearm. More specifically, the bore guide can include a rear housing, an adjustable shaft with a top on its end, a spring housing connected to the proximal end of the adjustable shaft, a compressible spring located inside the spring housing to allow the adjustable shaft to transition towards the rear housing, and a lock that is insertable into a portion of a firearm to lock the spring in its compressed state. Therefore, when the bore guide is inserted into the barrel, it can easily be secured in place by pushing the adjustable shaft and the rear housing towards each other, thereby compressing the spring, and securing the bore guide in its compressed state using a lock. This spring-loaded compression prevents the bore guide from falling out of the barrel and ensures no extraneous solvent will leak into the bore or onto undesirable areas of the firearm.

Figure 2:
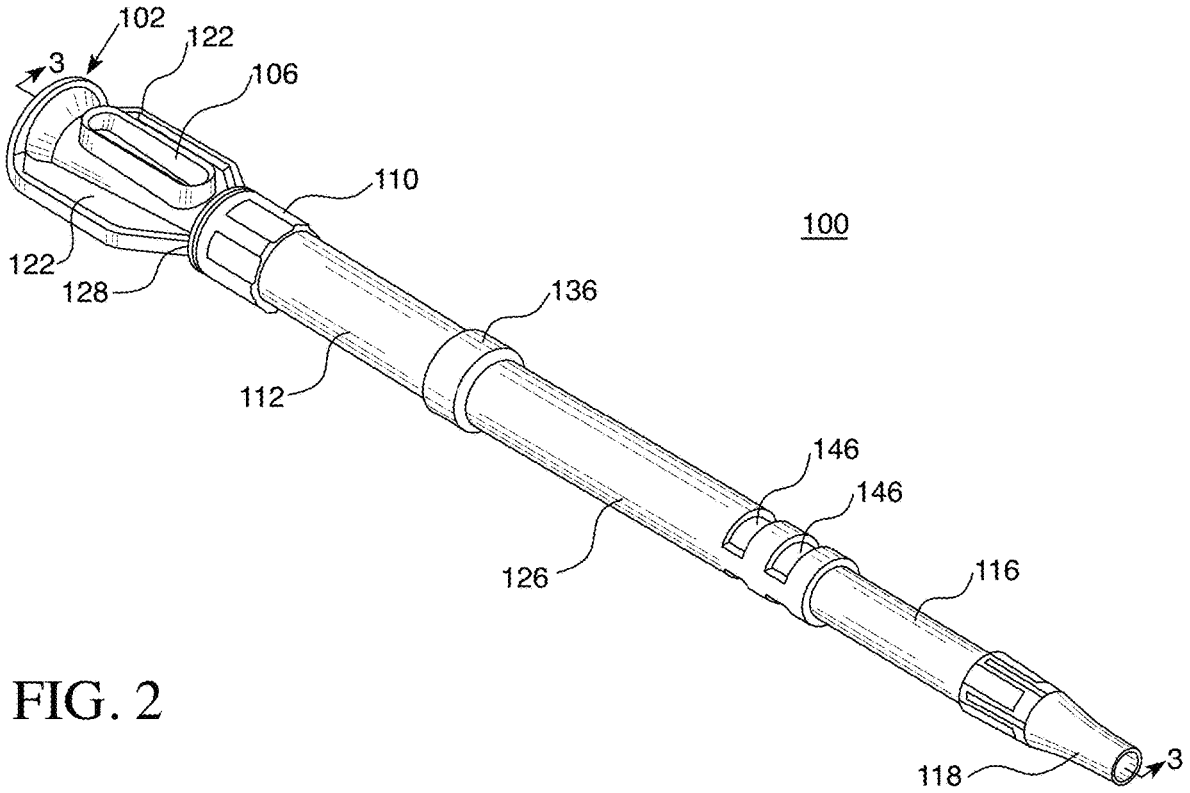
FIG. 2 is a top perspective view of the bore guide of FIG. 1 with accessories removed.
Figure 3:
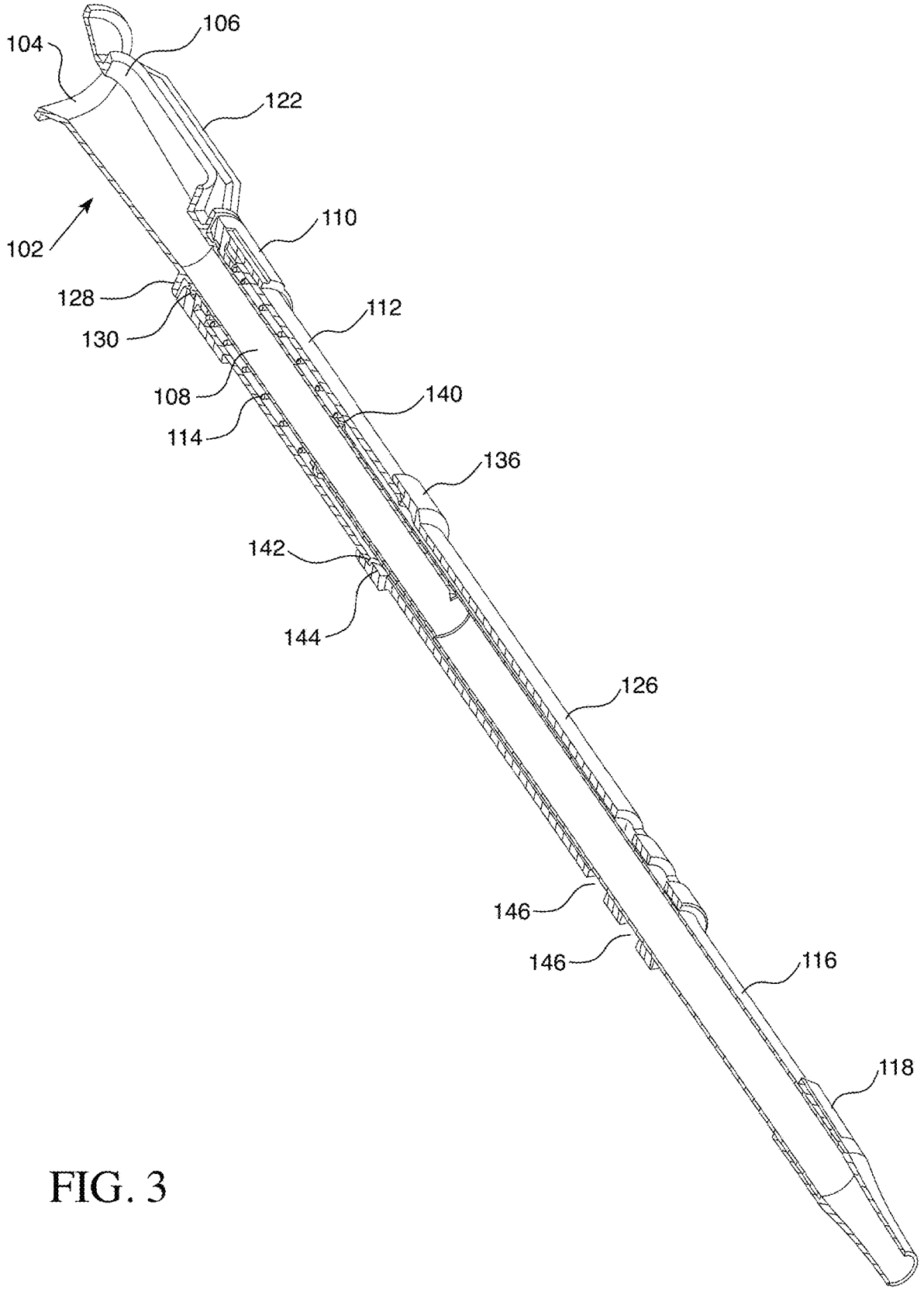
FIG. 3 is a cross-sectional view of the bore guide of FIG. 2 taken from line 3-3.
Figure 4:
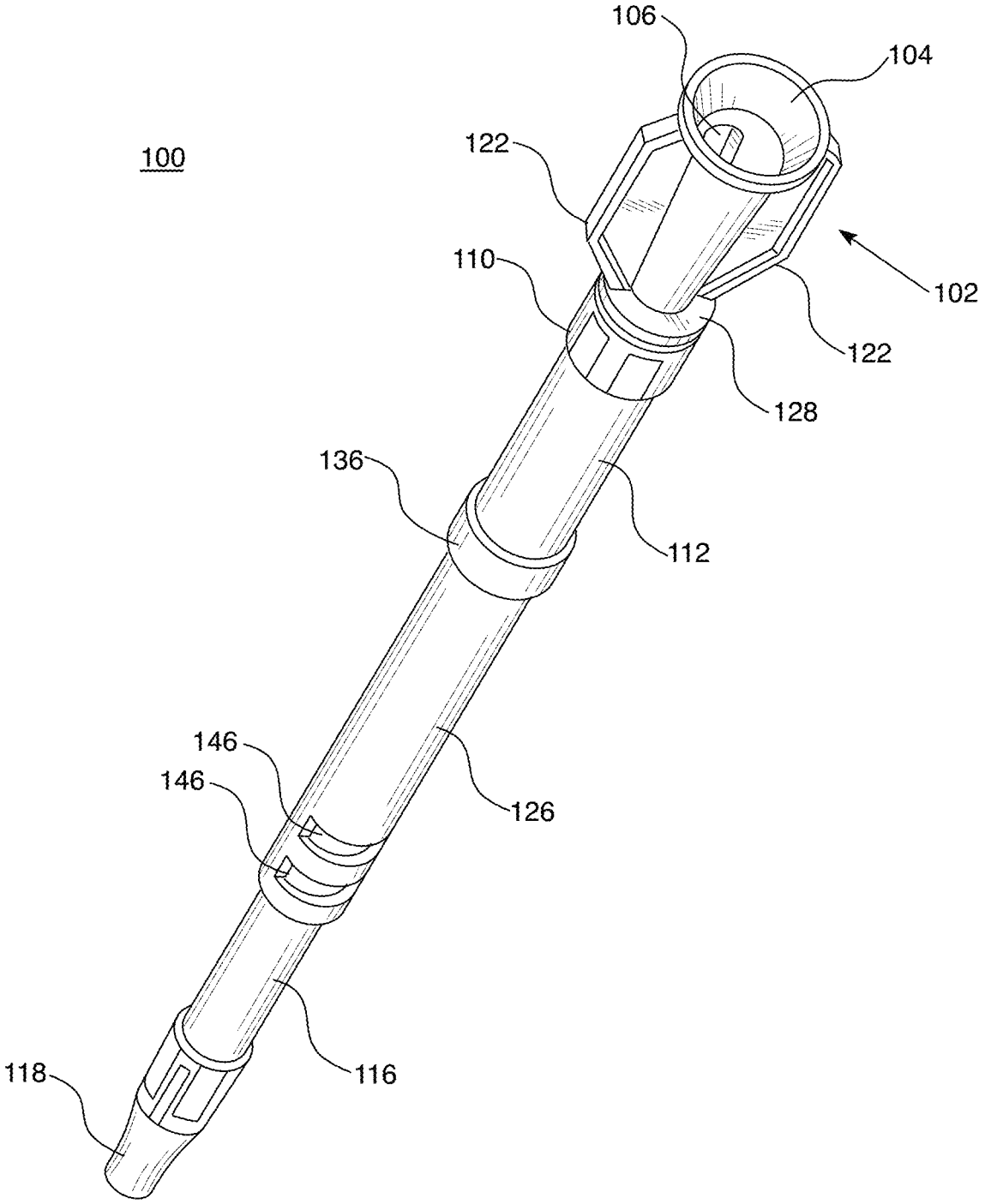
FIG. 4 is a bottom perspective view of the bore guide of FIG. 2.
Figure 5:
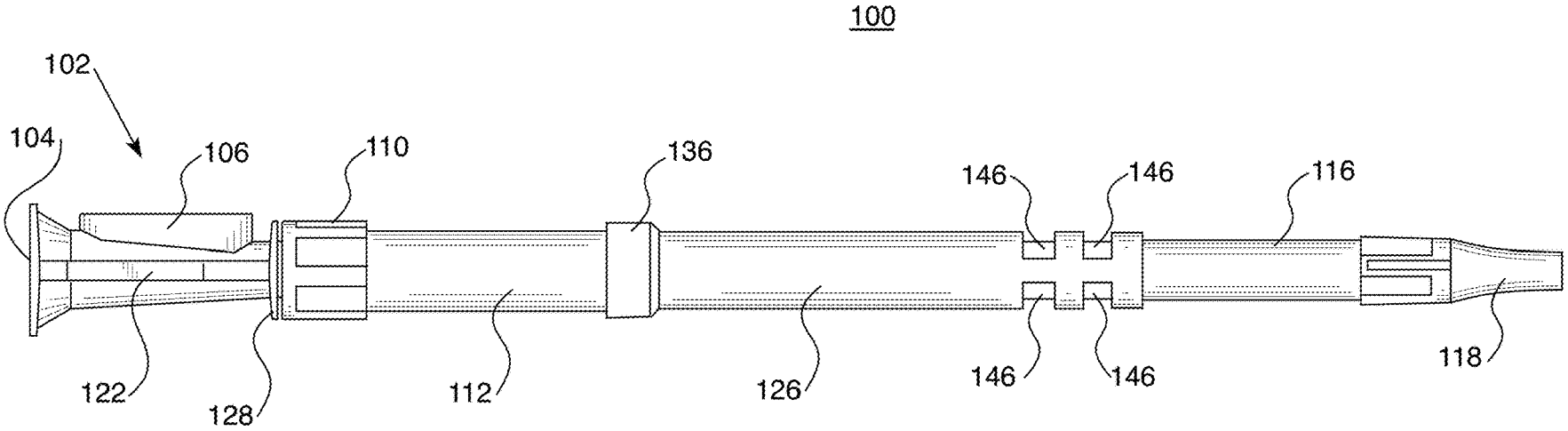
FIG. 5 is a side view of the bore guide of FIG. 2.
Figure 6:
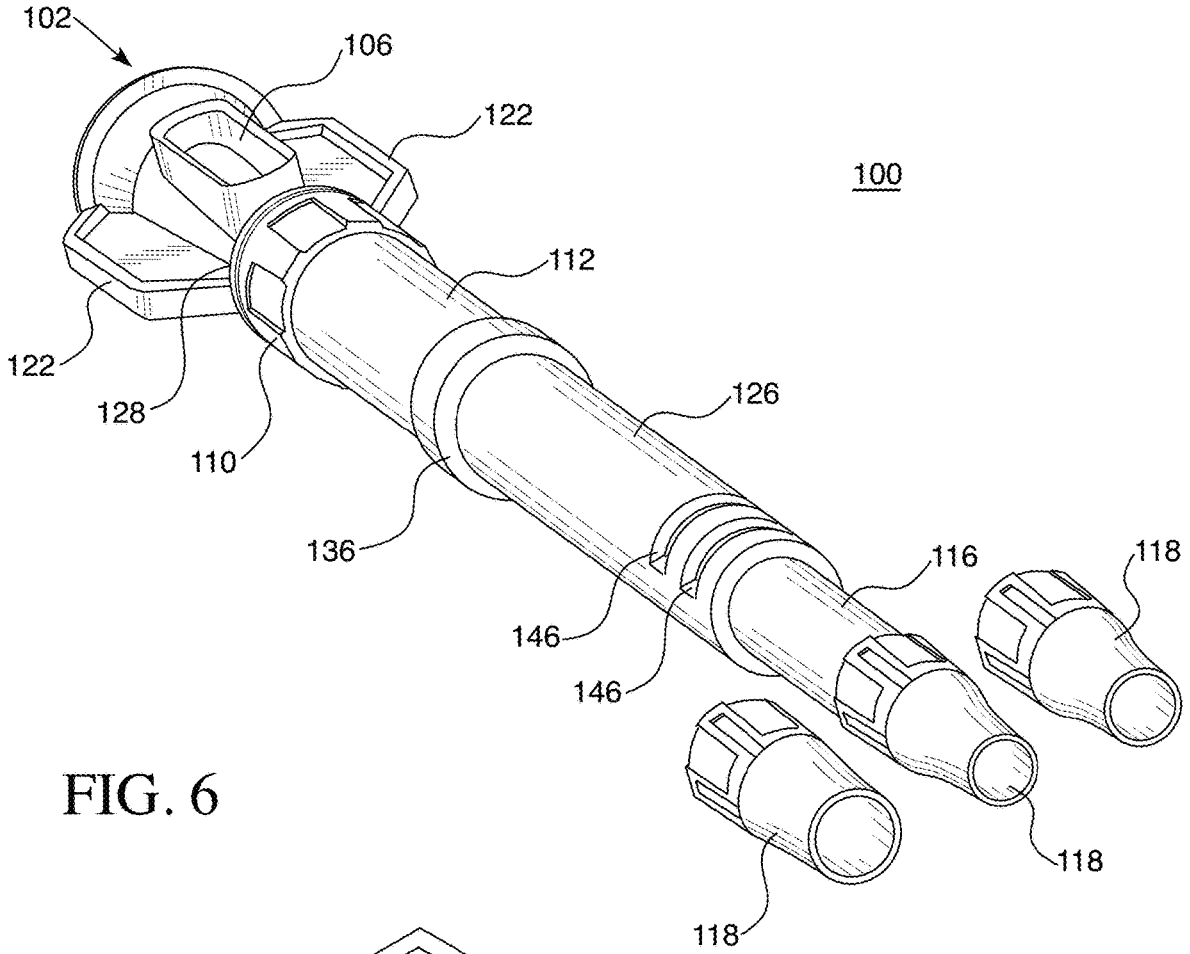
FIG. 6 is a front perspective view of the bore guide of FIG. 2 with additional tips shown next to an installed tip.
Figure 7:
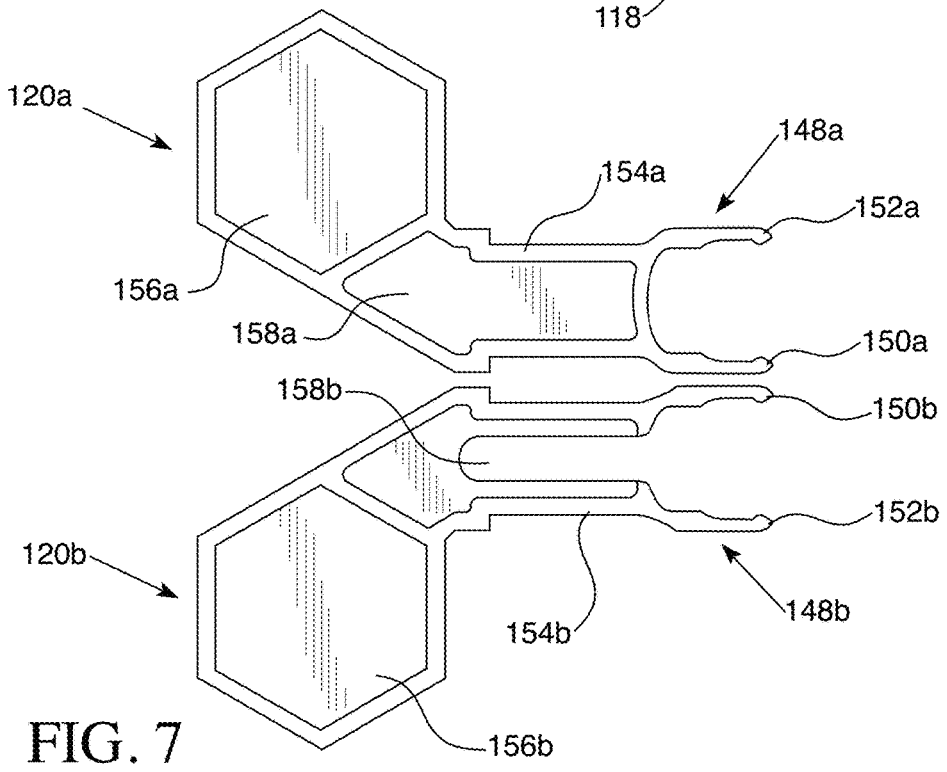
FIG. 7 is a top view of accessory keys of the bore guide of FIG. 1.
Figure 8:
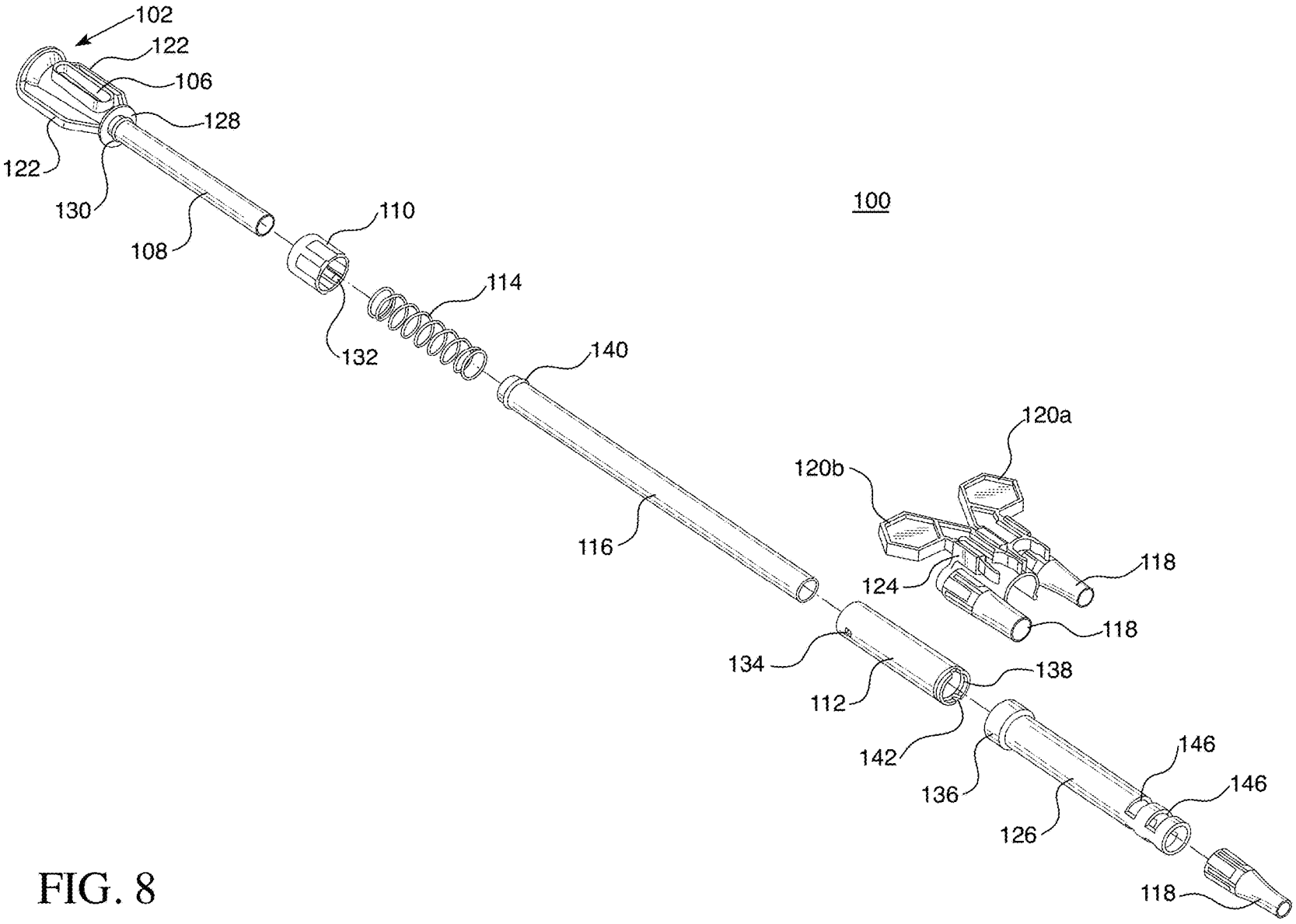
FIG. 8 is an exploded view of the bore guide of FIG. 1.
Figure 9:
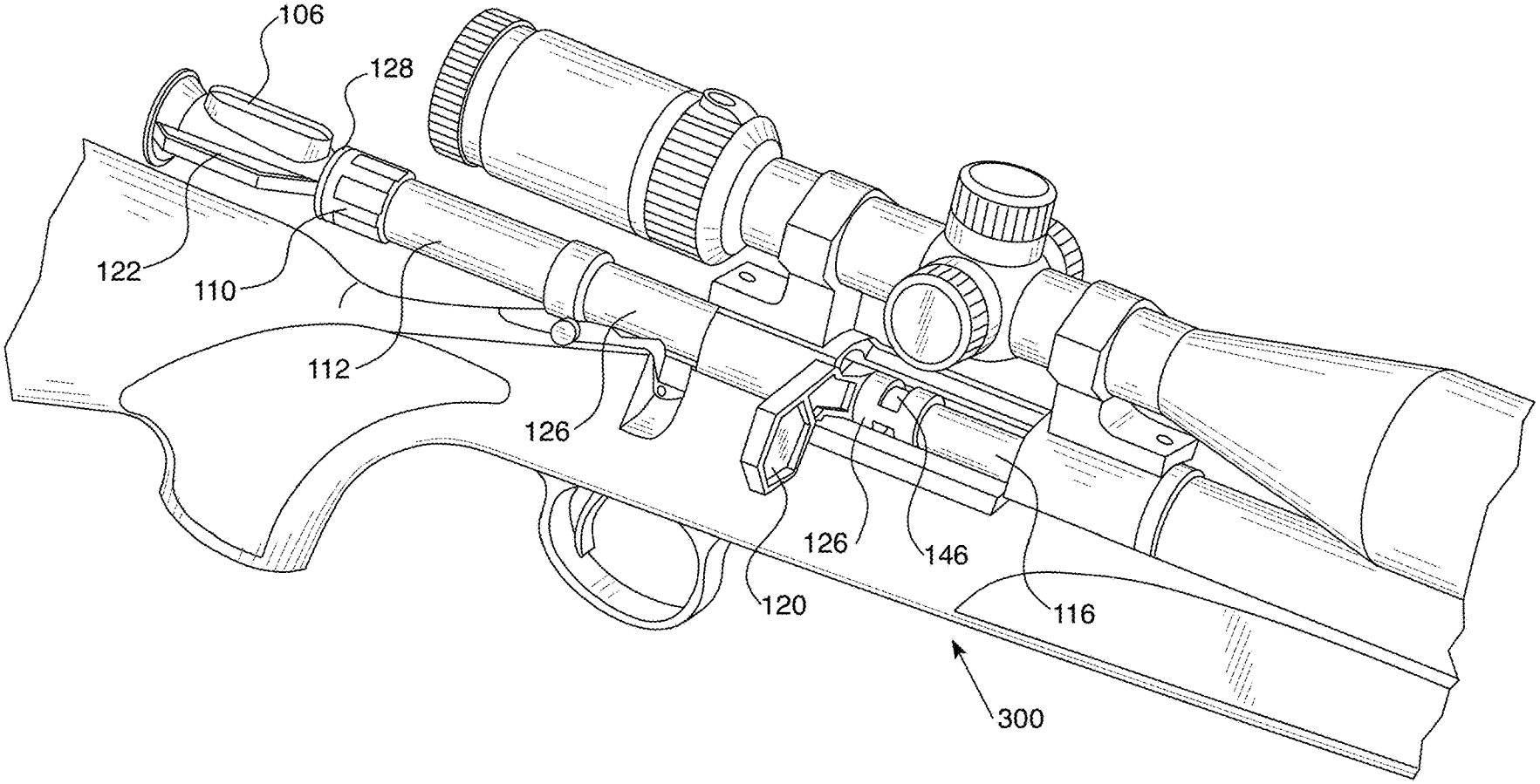
FIG. 9 illustrates a side perspective view of the bore guide of FIG. 2 installed in a firearm with the key engaged.
Figure 10:
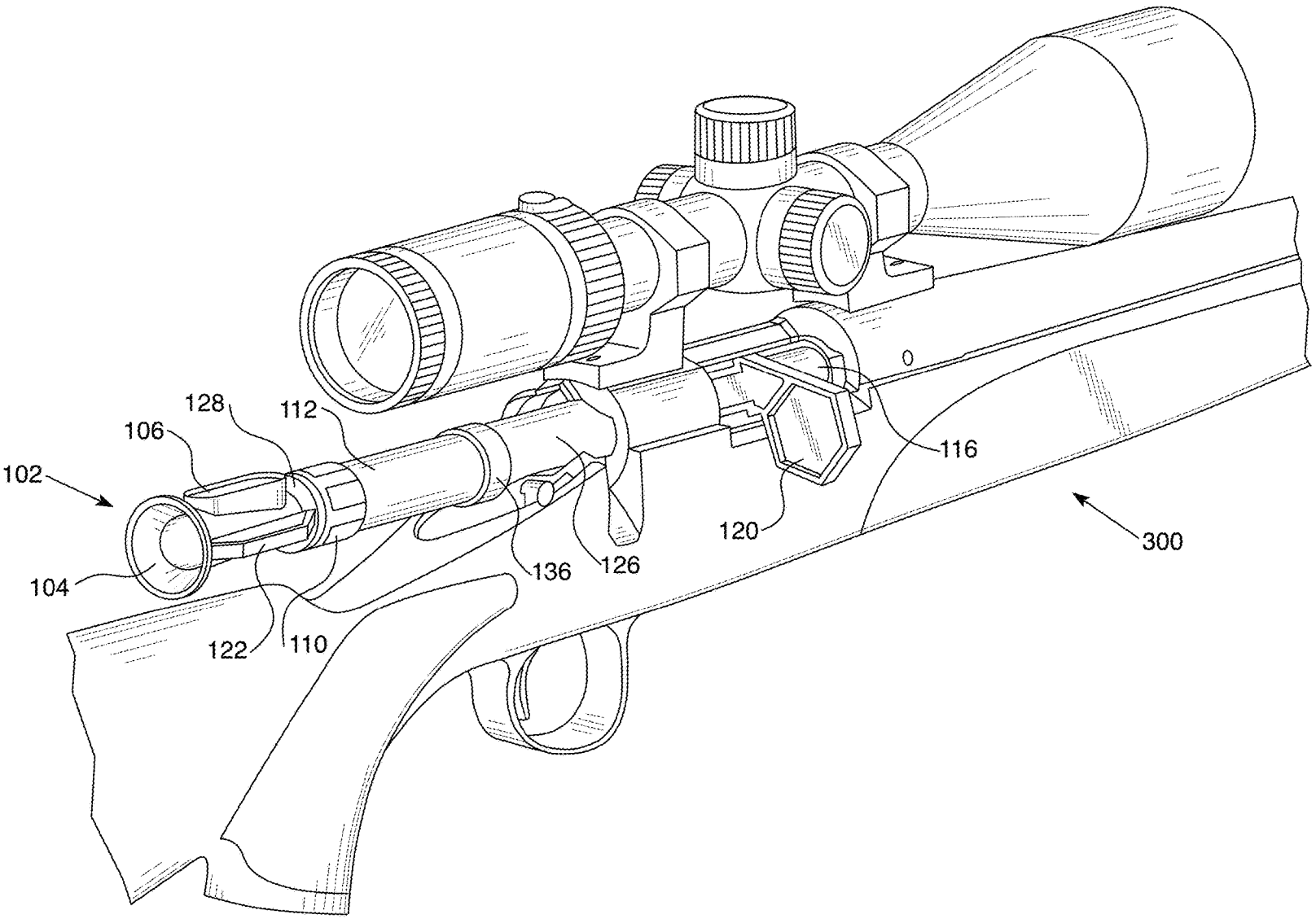
FIG. 10 illustrates a rear perspective view of the bore guide of FIG. 2 installed in a firearm with the key engaged.
Figure 11:
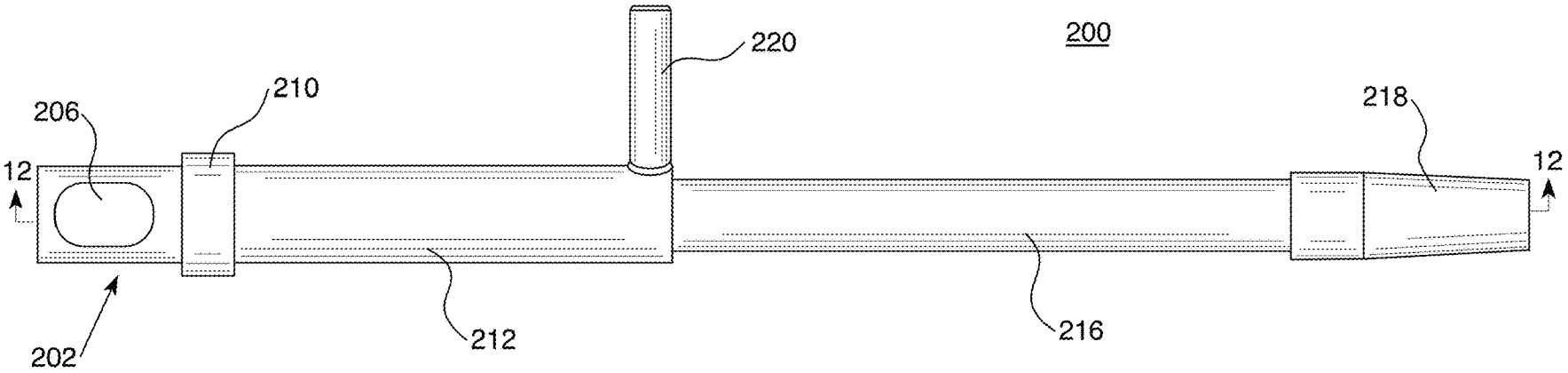
FIG. 11 is a top view of a bore guide according to a second embodiment of the present disclosure.
Figure 12:
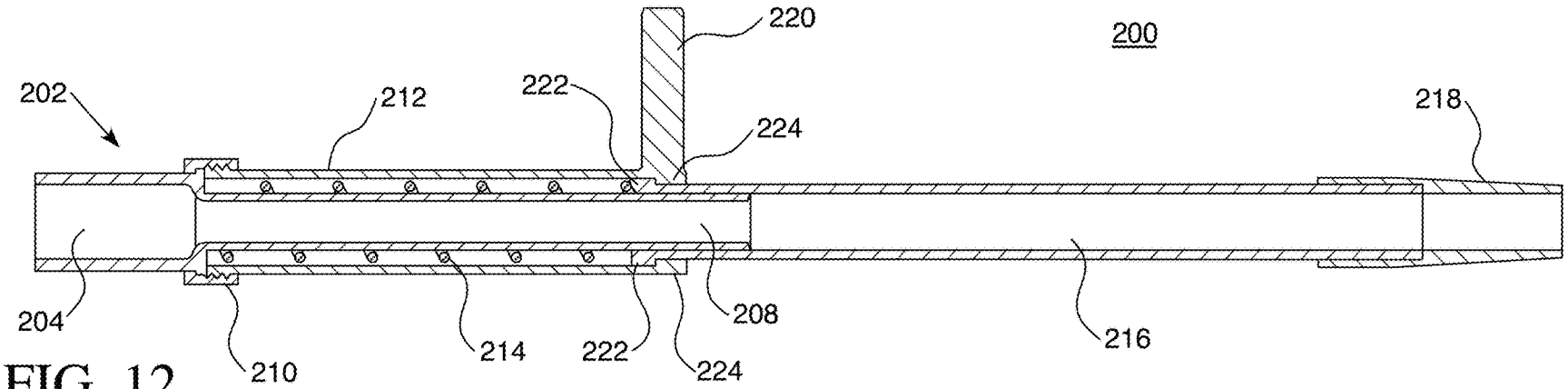
FIG. 12 is a cross-sectional view of the bore guide of FIG. 11 taken from line 12-12.
Figure 13:
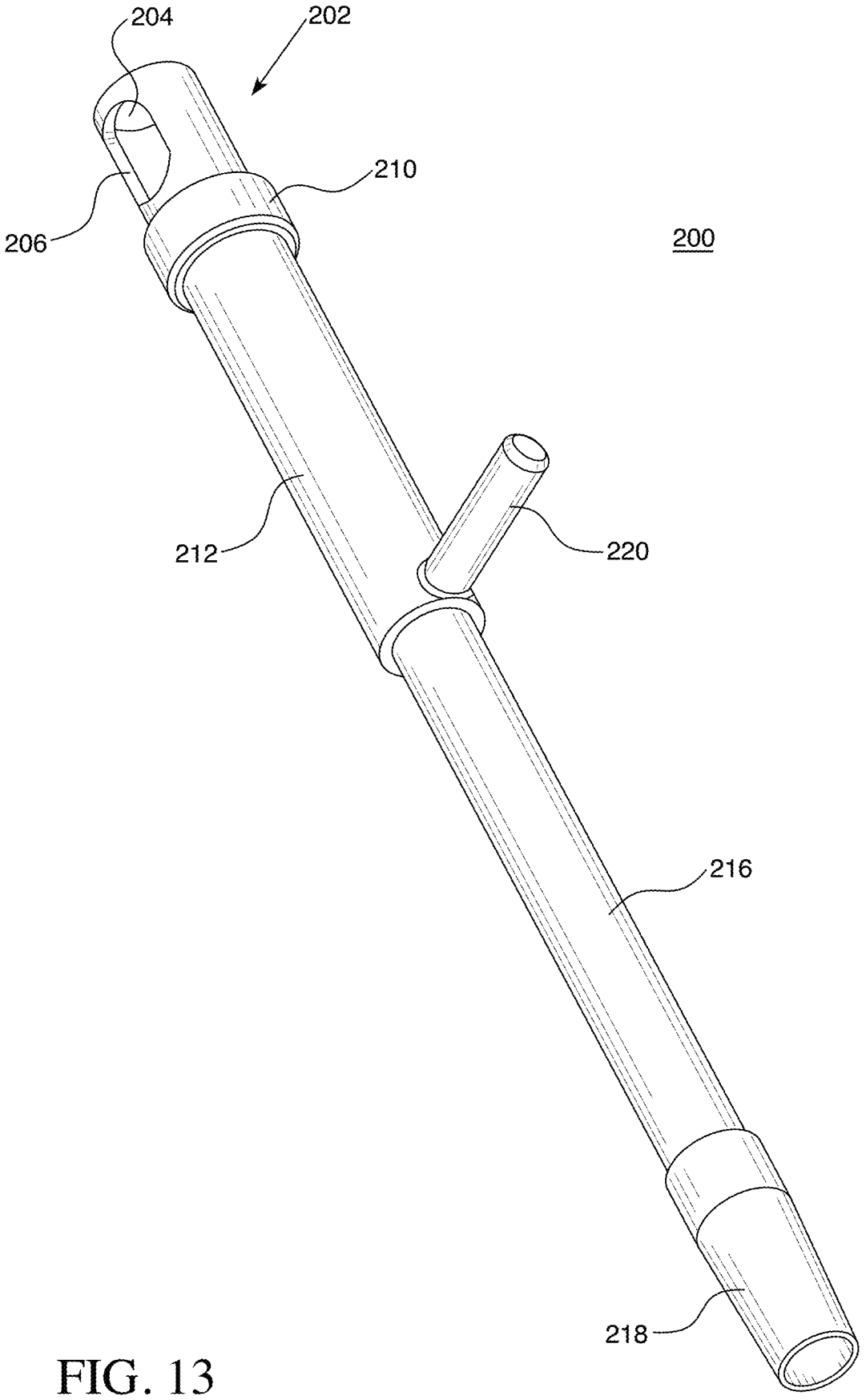
FIG. 13 is a front perspective view of the bore guide of FIG. 11.

FIGS. 1-13 illustrate various views of an example of a bore cleaning tool according to the present disclosure. FIG. 1 is a top perspective view of a bore guide with attached accessories according to a first embodiment. FIG. 2 is a top perspective view of the bore guide of FIG. 1 with accessories removed. FIG. 3 is a cross-sectional view of the bore guide of FIG. 2. FIG. 4 is a bottom perspective view of the bore guide of FIG. 2. FIG. 5 is a side view of the bore guide of FIG. 2. FIG. 6 is a front perspective view of the bore guide of FIG. 2 shown with additional tips. FIG. 7 is a top view of accessory locks of the bore guide of FIG. 1. FIG. 8 is an exploded view of the bore guide of FIG. 1. FIG. 9 illustrates a side perspective view of the bore guide of FIG. 2 installed in a firearm with the lock engaged. FIG. 10 illustrates a rear perspective view of the bore guide of FIG. 2 installed in a firearm with the lock engaged. FIG. 11 is a top view of a bore guide according to a second embodiment. FIG. 12 is a cross-sectional view of the bore guide of FIG. 11. FIG. 13 is a front perspective view of the bore guide of FIG. 11.

Generally, the bore guide is roughly cylindrical with a long length compared to its diameter. In some embodiments, the bore guide can have, from distal end to proximal end, a tip, an adjustable shaft, a spring housing with a spring inside, and rear housing with a rear opening and a solvent port. The tip can be compressible and can be comprised entirely of a single, compressible or flexible material (for example, a thermoplastic elastomer or polypropylene) or type of material (for example, polymers) or it can be comprised of a combination of materials. Additionally, the tip can be removable from the distal end of the adjustable shaft. The adjustable shaft, spring housing, and rear housing can be comprised of one or more rigid materials (for example, aluminum, plastic, or steel) that cannot be easily compressed or removed from each other. The lock(s) can also be comprised of one or more rigid materials but can be secured to and removed from the bore guide as needed. The spring can be a made from metal and can be a compression spring that resists compression. More specifically, in some cases, the adjustable shaft and spring housing can be comprised of aluminum and the remainder of the device, aside from the spring and the tip, can be comprised of plastics.

As illustrated in FIG. 1, bore guide 100 can be comprised of rear housing 102, spring housing 112, spring 114, adjustable shaft 116, tip 118, and a lock (such as key 120). Rear housing 102 can further be comprised of rear opening 104, solvent port 106, and guide tube 108. Further, the rear housing 102 can include a pair of wings 122 positioned on either side of solvent port 106. Some of these same features can be present in a second embodiment of the bore guide. More specifically, as illustrated in FIG. 11, bore guide 200 can also be comprised of rear housing 202, spring housing 212, spring 214, adjustable shaft 216, tip 218, and a lock (such as handle 220), wherein rear housing 202 can further be comprised of rear opening 204, solvent port 206, and guide tube 208.

As illustrated in FIGS. 3 and 12, the bore guide can be hollow to accommodate insertion of cleaning rods and pass through of solvents that are inserted into a rear (proximal) end of the bore guide. To guide cleaning rods and solvents into place, rear housing 102 can be approximately cylindrical and can include openings. More specifically, rear housing 102/202 can include rear opening 104/204, which can be positioned on a proximal end of rear housing. In some embodiments, rear opening can be funnel shaped, as illustrated in FIGS. 3-5, such that it helps guide a cleaning rod into the primary internal cavity of bore guide 100. Additionally, rear housing 102/202 can include solvent port 106/206 on a top, circumferential portion of the rear housing. Solvent port can simply be an opening in rear housing, as illustrated in FIGS. 11 and 13, or it can include vertical walls, as illustrated in FIGS. 1-2.

As illustrated in FIG. 5, rear opening 104 and rear housing 102 can be funnel shaped, with rear opening having a faster decrease in circumference compared to rear housing. As such, the vertical walls of solvent port 106 may not be the same height from their proximal end to their distal end. As illustrated in FIG. 5, they may be shorter on their proximal end, where rear housing 102 has a larger diameter, than they are on their distal end, where rear housing has a small diameter.

In addition to rear opening 104 and solvent port 106, rear housing 102 can include wings 122. Wings 122 can be positioned on either side of solvent port 106 for the purpose of catching any spills when solvent is being added to bore guide 100. Therefore, wings 122 can be at least as long as solvent port 106 and include raised edges with a lowered floor, as illustrated in FIG. 6, in order to contain spilled liquids, such as solvents. In some embodiments, wings 122 may run the complete length of rear housing 102. Wings 122 may have any shape, but in some cases, are approximately trapezoidal. Other shapes that wings 122 may take are half circles, approximate rectangles, etc.

As mentioned above, rear housing may 102/202 also have guide tube 108/208. Guide tube 108/208 is primarily internal to bore guide 100/200, as illustrated in FIGS. 3 and 12. As such, if wings 122 are present, they may not run the entire length of rear housing 102, but end where guide tube 108 begins. The purpose of guide tube 108/208 is to ensure solvents and other cleaning liquids are retained in bore guide 100/200 until they reach their desired distribution point within the bore. As illustrated in FIGS. 9-10, when bore guide 100 is inserted in a firearm 300, solvent port 106 may be positioned over the firearm stock and can be considerably far removed from the barrel entrance. Therefore, guide tube 108/208 connects solvent port 106/206 to an interior portion of adjustable shaft 116/216, as illustrated in FIGS. 3 and 12, to ensure solvents and other liquids that could potentially damage the outside of the firearm are contained. Guide tube 108/208 can be, simply, an elongate, hollow cylindrical tube made from any type of rigid material such as plastics or metals.

To connect rear housing 102/202 to the rest of bore guide 100/200, joiner 110/210 may be structured and configured to join rear housing to spring housing 112/212. More specifically, rear housing 102 may have large collar 128 on guide tube 108 near the distal end of solvent port 106 and wings 122, as illustrated in FIG. 8. Additionally, rear housing may have small collar 130 positioned distally from large collar 128. Joiner 110 can have a ledge on a proximal end that hooks over small collar 130 such that an upper portion of joiner is positioned between small collar and large collar 128, as illustrated in FIG. 3. Joiner 110 may also then have at least one hook 132 (although in some cases more than one) near a distal end on an internal surface that can hook into window 134 on spring housing 112. In some embodiments, there may be two windows 134 opposite each other on spring housing 112 and two hooks 132 opposite each other on an internal surface of joiner 110. With joiner 110 attached to rear housing 102 and spring housing 112 as described above, it allows for rear housing 102 to continuously spin/rotate around a central axis point even when bore guide 100 is secured in a firearm and incapable of otherwise spinning. Therefore, rear housing 102 can have a frictional, rotating union with joiner 110, which enables solvent port 106 to be rotated into an upright position if it is out of place when bore guide 100 is inserted into a firearm so that a user can pour solvents or other liquids into bore guide while minimizing the risk of spillage.

Internal to spring housing 112/212 may be spring 114/214. In some cases, spring housing 112/212 is a (mostly) uniformly radial, hollow cylinder made from any type of rigid material such as plastics or metals. Spring 114/214 may be as long, or longer, than spring housing 112/212 such that even in the bore guide's default, expanded state, there is still force pushing adjustable shaft 116/216 away from rear housing 102/202. In addition to wrapping around spring 114/214, spring housing 112/212 may also wrap around guide tube 108/208, as illustrated in FIGS. 3 and 12.

While a proximal end of spring housing 112 may be connected to joiner 110, as described above, a distal end of spring housing can connect to cover 126. More specifically, to assist with the connection between spring housing 112 and cover 126, an internal portion of the proximal end of cover may include raised tab portions (not visible). These tabs can create a friction fit with spring housing 112 and can keep spring housing and cover 126 connected. Further, a distal end of spring housing 112 can have inset cavity 142, illustrated in FIG. 8, that pairs to a similarly shaped protrusion 144 on an inner surface of cover 126, illustrated in FIG. 3. This pairing helps to prevent spring housing 112 from rotating within cover 126.

Spring housing 112 may also include window(s) 134, as described above, for pairing to hook(s) 132 of joiner 110, and internal bumper 138, as illustrated in FIGS. 3 and 8. Internal bumper 138 can function to prevent spring 114 from sliding past internal bumper, thereby forcing it to compress within spring housing 112, instead of remaining decompressed within bore guide 100, when adjustable shaft 116 is pushed toward rear housing 102. Internal bumper 138 can effectively be a circumferential protrusion positioned on an internal portion of spring housing 112 near its distal end.

As mentioned herein, spring 114/214 can be located inside spring housing 112/212 and can surround guide tube 108/208 as well as adjustable shaft 116/216. Spring 116/216 can be made of a metal such as, but not limited to, spring steel. Spring 114/214 can be a compression spring that, as mentioned above, is in a default semi-compressed state even with bore guide 100/200 is fully extended. Therefore, spring 114/214 may always be applying a force against adjustable shaft 116/216, pushing adjustable shaft and rear housing 102/202 away from each other. However, this is not required and, in some embodiments, spring 114/214 may be in a relaxed, expanded state when bore guide 100/200 is in its fully extended configuration.

As with spring housing 112/212, adjustable shaft 116/216 can be a (mostly) uniformly radial, hollow cylinder made from any type of rigid material such as plastics or metals. Structurally, adjustable shaft 116 can be configured such that its proximal end is located interior to spring housing 112 and spring 116, its central portion is located interior to cover 126, and its distal end is pairable with removable tip 118, as illustrated in FIG. 3. Alternatively, adjustable shaft 216 can be configured such that its proximal end is located interior to spring housing 212, next to spring 216, its central portion is completely exposed, and its distal end is pairable with removable tip 218, as illustrated in FIG. 12. Additionally, guide tube 108/208 can run the length of spring housing 112/212 and end inside adjustable shaft 116/216, as illustrated in FIGS. 3 and 12.

In some embodiments, adjustable shaft 116 may include external bumper 140, illustrated in FIGS. 3 and 8, which can be similar to internal bumper 138 on spring housing 112 except that external bumper can be a circumferential protrusion located on an external portion of the proximal end of adjustable shaft instead of being located on an internal portion of a distal end. Similar to internal bumper 138, external bumper 140 may function to prevent spring 114 from sliding past the bumper. In other embodiments, adjustable shaft 216 may include external lip 222, illustrated in FIG. 12, that can be a circumferential protrusion located on an external portion of the proximal end of adjustable shaft. External lip 222 may be stopped by an internal lip 224 on an interior surface of spring housing 212 to prevent spring housing and adjustable shaft 216 from separating.

In some embodiments, adjustable shaft 116/216 can be the longest component in bore guide 100/200. This can enable it to cause bore guide 100/200 to have a range of lengths. For example, adjustable shaft 116/216 can effectively be telescoped inside spring housing 112/212 and, in some embodiments, cover 126, thereby shortening the overall length of bore guide 100/200. Further, when bore guide 100/200 is inserted into a firearm, it can be locked in place due to a combination of this telescoping feature and spring compression. More specifically, pushing adjustable shaft 116/216 and rear housing 102/202 closer in proximity to each other positions adjustable shaft 116/216 further inside spring housing 112/212. This movement of adjustable shaft 116/216 towards rear housing 102/202 causes external bumper 140 or, alternatively, external lip 222, to compress at least a portion of spring 114/214, which then applies force to tip 118/218, thereby creating a seal between bore guide 100/200 and a firearm. As described further below, a lock, such as key 120, can be secured around portions of adjustable shaft 116 and cover 126 to secure bore guide 100 in this configuration. Alternatively, in one embodiment, the bolt of a firearm can be removed and bore guide 200 can replace the bolt during cleaning. In such an embodiment, the lock can be handle 220.

In embodiments where key 120 can be used, cover 126 can include one or more key slots 146, illustrated in FIGS. 1, 5, and 8, which are gaps in cover that allow key 120 to secure around adjustable shaft 116, as illustrated in FIGS. 9-10. There may be one or more key slots 146 present on cover 126. For example, there may be a first key slot on a top of cover 126 and a second key slot mirrored on a bottom of cover. In another example, there may be a first key slot on a top of cover 126 and a second key slot positioned either behind (proximal to) or in front (distal to) the first key slot. In some cases, there may be two or more key slots 146 on a top of cover 126 and two or more key slots on a bottom of cover, as illustrated in FIG. 5. By including multiple key slots 146 positioned behind or in front of each other, bore guide 100 can accommodate a wider variety of firearm sizes.

Key slots 146 may be arcuate cutouts or gaps in cover 126. In some embodiments, as illustrated in FIG. 9, an upper and lower key slot 146 may have an amount of cover material between them that is less than the width of grip 148 of key 120, such that key can have top arm 150 of grip that penetrates through key slot to grip onto an upper portion of adjustable shaft 116 and bottom arm 152 of grip that penetrates through a lower key slot to grip onto a lower portion of adjustable shaft. Top and bottom arms 150, 152 may be interchangeable in that top arm may grip onto a lower portion of adjustable shaft 116 and bottom arm may grip onto an upper portion of adjustable shaft.

In addition to key slot(s) 146, cover 126 may encase at least a portion of both adjustable shaft 116 and spring housing 112, as illustrated in FIGS. 1-3 and 5, to fully secure adjustable shaft to spring housing. With the exception of key slot(s) 146, cover 126 may be a uniformly radial, hollow cylinder, similar to adjustable shaft 116 and housing 112. Alternatively, cover 126 may have a uniformly radial, hollow cylinder portion on which key slot(s) 146 is/are located and may have cover cap 136. Cover cap 136 can also be a hollow cylinder on a proximal end of cover 126 such that the internal portion of cover that includes raised tab portions (not visible) for creating a friction fit with spring housing 112, as described above, is actually the internal portion of cover cap. Therefore, cover cap 136 may be the portion of cover 126 that keeps spring housing 112 and cover connected. Additionally, protrusion 144 may be on an inner surface of cover cap 136 and may be the portion of cover 126 that pairs to inset cavity 142 on spring housing 112. Cover cap 136 may have a beveled distal end portion that leads to the rest of cover 126, such that cover cap has a larger diameter than cover and a larger dimeter than spring housing 112. Additionally, as illustrated in FIG. 3, spring housing 112 may only engage with cover cap 136, while adjustable shaft 116 may engage primarily with cover 126. In some cases, the diameter of cover 126 may be equivalent to, or less than, the diameter of spring housing 112. Therefore, the beveled portion of cover cap 136 may be located distally past spring housing 112 and over adjustable shaft 116.

As mentioned herein, the combination of the above-described elements of bore guide 100/200 may function similar to a spring-loaded telescope, with certain components having larger or smaller diameters than others. More specifically, in some embodiments, cover cap 136 and/or joiner 110/210 may have the largest diameters as they both surround at least a portion of spring housing 112/212. The relative diameters of the rest of the cylindrical components compared to each other may be, in order of larger diameter to smaller diameter, spring housing 112/212, spring 114/214, cover 126, adjustable shaft 116/216, and guide tube 108/208. The remaining components of bore guide 100/200 may include tip 118/218 and key 120 or handle 220, described in more detail below.

Because it is undesirable to get cleaning implements and liquids in the firearm chamber, tip 118/218 is structured and configured to effectively seal inside the action of a firearm. More specifically, tip 118/218, in addition to being configured of a flexible or compressible material such as, but not limited to, polypropylene, and may be approximately cone shaped with an elongated base portion that leads to an angled portion and a blunt distal end, as illustrated in FIGS. 5 and 12. Tip 118/218 can have an open proximal end, an open distal end, and a hollow interior. The open proximal end and elongated base portion can attach to a distal end of adjustable shaft 116/216, as illustrated in FIGS. 3 and 12. The angled portion and blunt distal end may not otherwise engage with any other portion of bore guide 100/200 but may be secure inside the barrel of a firearm, as FIG. 10 suggests.

In some embodiments, tip 118/218 is removably engaged with adjustable shaft 116/216. This is because tip 118/218 may be replaceable with other tips having different sizes or configurations to accommodate different calibers on different types and styles of firearms. For example, one tip may be structured and configured to pair with a first range of calibers. Another may be structured and configured to pair with a second range of calibers. A third may be structured and configured to pair with a third range of calibers. Three example tips are illustrated in FIG. 6, wherein the smallest caliber tip is engaged on the bore guide and the medium and larger calibers tips are shown to either side. Tip 118/218 may secure to adjustable shaft 116/216 using a friction fit or a threaded fit.

As mentioned above, bore guide 100/200 can lock into firearm in order to create a seal that ensures solvents or other chemicals are retained within the bore of the firearm. In some embodiments, the lock can be key 120 and, in other embodiments, the lock can be handle 220. More specifically, key 120 can be a lock that allows bore guide 100 to be secured inside the barrel of a firearm. More specifically, key 120 can be structured and configured to transiently fit into key slot 146 and can retain bore guide 100 in place within a firearm. More specifically, the combination of key 120 and key slot 146 creates a "jam lock" that prevents bore guide from pushing back out of the firearm by having key make contact with the back surface of the firearm, as illustrated in FIG. 9. Key 120 can have a snap-fit connection with adjustable shaft 116, and can be comprised of three primary components: grip 148, neck 154, and head 156. Grip 148 can have two arms with open space between them that allows grip to secure onto adjustable shaft 116. Neck 154 can be an elongate portion of key 120 that provides distance between grip and head 156 so that a user can more easily insert and remove key from an ejection port. Head 156 can be a relatively flat, wide component that is sized large enough for a user to be able to grasp easily and ergonomically.

As mentioned above, grip 148 can have two arms such as a first, top arm 150 and a second, bottom arm 152 (the top and bottom being interchangeable in use). Top and bottom arms 150, 152 can be mirror images of each other such that the features present on one are mirrored in the other. As illustrated in both embodiments in FIG. 7, the space between arms 150 and 152 may be greater toward a tip of the arms (distal grip space) compared to the space between arms toward neck 154 (proximal grip space). Distal grip space may have a length that is approximately similar to the diameter of adjustable shaft 116, while proximal grip space may have a depth approximately similar to the thickness of cover 126. Additionally, the distalmost portions of arms 150 and 152 may have interior bumps. Therefore, when key 120 is slid onto adjustable shaft 116 in a perpendicular configuration, arms 150 and 152 may flex outward until they reach past the widest point of the cross-section of adjustable shaft and may then snap back into their original position. When secured on adjustable shaft 116, the proximal grip space may contain the portion of cover 126 between top and bottom key slots 146.

Connected to the proximal portion of grip 148 can be neck 154. As mentioned above, neck 154 is an elongate portion that connects to, and provides distance between, grip 148 and head 156 so that a user does have to reach directly into the ejection port to remove key 120. Neck 154 may be approximately rectangular and may be narrower than grip 148, as illustrated in both embodiments in FIG. 7. In some embodiments, neck 154*a* may have solid interior 158*a* whereas in other embodiments, neck 154*b* may have interior slot 158*b* running between grip 148*b* and head 156*b*, as shown in FIG. 7. Interior slot 158*b* may be narrower than either distal grip space or proximal grip space in grip 148*b*.

Head 156, as mentioned above, can be relatively flat and wide and can be sized large enough for a user to be able to easily grasp. In some embodiments, head may have an angled portion off of neck 154 and a wider gripping portion, as illustrated by both embodiments in FIG. 7. However, the angled portion is not required and, in other embodiments, the gripping portion of head 156 may directly connect to neck 154. As illustrated, head 156 may be hexagonal in shape and relatively flat. However, head 156 may take other shapes such as circular, squared, rectangular, or any other polygonal shape.

While the above-described components are present in most embodiments of key 120, grip 148 and neck 154 may have minor variations between different embodiments. For example, grip 148*a* of key 120*a* may be slightly wider with slightly more rounded components compared to grip 148*b* of key 120*b*. Additionally, neck 154*a* of key 120*a* may have solid interior 158*a* while neck 154*b* of key 120*b* may have interior slot 158*b* running along its length. These minor variations allow different keys 120 to work on different firearms. For example, key 120*a* may work best for bolt action rifles while key 120*b* may work best for firearms with small ejection ports, such as AR platforms. Interior slot 158*b* allows for grip 148*b* and neck 154*b* to be pinched together to fit through a smaller ejection port opening.

As mentioned above, in another embodiment, the lock of bore guide 200 can be handle 220. More specifically, in this embodiment, the bolt of a firearm can be removed and bore guide 200 can replace the bolt during cleaning. In such an embodiment, the lock of bore guide can be handle 220 that can be rotated (for example, up to 90 degrees) and locked into location (for example, into where the bolt handle would lock) with spring pressure. Handle 220 can have a cylindrical shape, as illustrated in FIG. 13, or it can have a more complex geometry, similar to other known bolt handles. Handle 220 can be located on a distal end of spring housing 212 and on a circumferential surface, as illustrated in FIG. 11.

In its completely assembled configuration, bore guide 100 can further include accessory mount 124, which can be mounted to spring housing 112, in order to store extra tip(s) 118 and keys 120. As illustrated in FIG. 1, accessory mount 124 may be located on a top portion of spring housing 112. Accessory mount 124 can be configured to have a snap fit connection with spring housing 112 and key(s) 120 and frictional fit connections with tip(s) 118.

More specifically, accessory mount 124 may have an open-ended cylindrical base that, in a cross-section, looks approximately omega-shaped. Accessory mount 124 can be comprised of flexible material, such as a plastic, that enables the opening to flex even further open in order to slide the cylindrical base over and around spring housing 112. This snap-fit connection of accessory mount 124 with spring housing 112 enables accessory mount to be easily removed and attached as needed.

For each key 120, accessory mount 124 may have a pair of arms with inward facing fingers. The length of the arms may be long enough that the key(s) 120 can be completely contained between the fingers and a lower base portion of accessory mount 124. As illustrated in FIG. 1, the arms on accessory mount 124 may be on a top portion such that the key(s) 120 are stored on an upper most spot on bore guide 100. There may be two sets of arms, therefore allowing accessory mount 124 to store two keys 120.

Tip(s) 118 may fit around hollow, cylindrical tip mounts of accessory mount 124 that are located off to the sides of the primary connection point of accessory mount to spring housing 112. The tip mounts may be below and to the side of the arms for key(s) 120 and may face forward, such that tip(s) 118, when connected, have a length that runs along the side of bore guide 100. There may be two tip mounts, such that one tip mount is on each side of accessory mount 124.

The various embodiments described above are provided by way of illustration only and should not be construed to limit the claims attached hereto. Those skilled in the art will readily recognize various modifications and changes that may be made without following the example embodiments and applications illustrated and described herein and without departing from the true spirit and scope of the following claims.

What is claimed is:

1. A bore guide for a firearm, the bore guide comprising:
a rear housing having a rear opening on a proximal end of the rear housing;
an adjustable shaft having a proximal and a distal end;
a tip on the distal end of the adjustable shaft;
a spring located between the rear opening and the adjustable shaft, wherein transition of the adjustable shaft toward the rear opening causes compression of the spring; and
a lock insertable into a portion of a firearm to lock the spring in a compressed state.

2. The bore guide of claim 1, wherein the lock is a key insertable into an ejection port of a firearm.

3. The bore guide of claim 1, wherein the rear housing is further comprised of
a solvent port on a circumferential portion of the rear housing, and
at least two wings flanking the solvent port on the circumferential portion of the rear housing.

4. The bore guide of claim 1, further comprising a cover for the adjustable shaft, wherein the cover is connected to a distal end of a spring housing that is connected to the proximal end of the adjustable shaft, and the adjustable shaft is slidable within the cover.

5. The bore guide of claim 4, wherein the cover is comprised of at least one key slot.

6. The bore guide of claim 5, wherein, when the bore guide is inserted into the firearm and compressed, the at least one key slot is accessible through an ejection port of the firearm.

7. The bore guide of claim 6, wherein the lock is comprised of a key that is insertable into the ejection port and pairable with the at least one key slot.

8. The bore guide of claim 1, further comprising a spring housing connected to the proximal end of the adjustable shaft, wherein the rear housing is rotatable relative to the adjustable shaft and the spring housing.

9. The bore guide of claim 1, wherein the rear housing is further comprised of a guide tube located within at least the spring.

10. The bore guide of claim 9, wherein
the guide tube is positioned between the rear housing and the adjustable shaft,
the guide tube is further located inside at least a portion of the adjustable shaft,
the guide tube is movable relative to the adjustable shaft, and
transition of the adjustable shaft toward the rear opening causes movement of the guide tube further into the adjustable shaft.

11. The bore guide of claim 1, wherein
the lock is a handle,
the lock is positioned between the spring and a distal end of the bore guide, and
and the bore guide is insertable into a receiver of the firearm.

12. The bore guide of claim 11, wherein the handle is located on a distal end of a spring housing that is connected to the proximal end of the adjustable shaft.

13. The bore guide of claim 1, wherein
the proximal end of the adjustable shaft is located within a spring housing that is connected to the proximal end of the adjustable shaft, and
the spring is positioned between a proximal end of the spring housing and the proximal end of the adjustable shaft.

14. A bore guide for a firearm, the bore guide comprising:
a rear housing having
a rear opening on a proximal end of the rear housing,
a solvent port on a circumferential portion of the rear housing, and
at least two wings flanking the solvent port on the circumferential portion of the rear housing;
an adjustable shaft having a proximal and a distal end;
a tip on the distal end of the adjustable shaft;
a spring housing connected to the proximal end of the adjustable shaft;
a spring located inside the spring housing, wherein transition of the adjustable shaft toward the rear opening causes compression of the spring;
a cover for the adjustable shaft, wherein the cover
is connected to a distal end of the spring housing,
is slidable along an outer portion of the adjustable shaft, and
is comprised of at least one key slot; and
a key that is pairable with the at least one key slot to lock the spring in a compressed state.

15. A bore guide for a firearm, the bore guide comprising:
a rear housing having
a rear opening on a proximal end of the rear housing,
a solvent port on a circumferential portion of the rear housing, and
a guide tube located within the spring housing and a portion of the adjustable shaft;
an adjustable shaft having a proximal and a distal end;
a tip on the distal end of the adjustable shaft;
a spring housing connected to the proximal end of the adjustable shaft;
a spring located inside the spring housing, wherein transition of the adjustable shaft toward the rear opening causes compression of the spring; and
a handle,
wherein the bore guide is insertable into a receiver of a firearm and the handle, when rotated downward into a locked position, locks the spring in a compressed state, and
wherein the handle is located on a distal end of the spring housing.

16. A method of using a bore guide, the method comprising:
inserting a distal end of the bore guide into a portion of a barrel of a firearm;
compressing a spring of the bore guide until a lock can be engaged with a portion of the firearm; and
engaging the lock to secure the compressed bore guide in place, wherein the lock is positioned between the spring and the distal end of the bore guide.

17. The method of claim 16, wherein the bore guide is comprised of
a rear housing having
a rear opening on a proximal end of the rear housing, and a solvent port on a circumferential portion of the rear housing;

an adjustable shaft having a proximal and a distal end;

a tip on the distal end of the adjustable shaft, wherein the tip is the distal end of the bore guide that is insertable into a portion of the barrel of the firearm;

a spring housing connected to the proximal end of the adjustable shaft;

a spring located inside the spring housing, wherein transition of the adjustable shaft toward the rear opening causes compression of the spring; and the lock, wherein the lock is engageable with a portion of the firearm to lock the spring in a compressed state.

18. The method of claim 16, further comprising pouring solvent into a solvent port that is located on a circumferential portion of a rear housing, wherein the solvent port is flanked by at least two wings on the circumferential portion of the rear housing.

19. The method of claim 17, further comprising inserting a cleaning rod through the rear opening of the rear housing.

20. The method of claim 16, further comprising:

disengaging the lock to allow the spring to decompress; and removing the bore guide from the firearm.

* * * * *